US011376850B2

(12) United States Patent
Koike et al.

(10) Patent No.: US 11,376,850 B2
(45) Date of Patent: Jul. 5, 2022

(54) LIQUID EJECTING HEAD AND LIQUID EJECTING APPARATUS

(71) Applicant: Seiko Epson Corporation, Tokyo (JP)

(72) Inventors: Harunobu Koike, Matsumoto (JP); Shunsuke Yoshida, Shiojiri (JP)

(73) Assignee: Seiko Epson Corporation

( * ) Notice: Subject to any disclaimer, the term of this patent is extended or adjusted under 35 U.S.C. 154(b) by 19 days.

(21) Appl. No.: 17/005,578

(22) Filed: Aug. 28, 2020

(65) Prior Publication Data

US 2021/0060949 A1 Mar. 4, 2021

(30) Foreign Application Priority Data

Aug. 30, 2019 (JP) ..... JP2019-157935

(51) Int. Cl.
*B41J 2/14* (2006.01)
*B41J 2/045* (2006.01)

(52) U.S. Cl.
CPC ..... *B41J 2/14233* (2013.01); *B41J 2/04581* (2013.01); *B41J 2002/14241* (2013.01); *B41J 2002/14491* (2013.01)

(58) Field of Classification Search
CPC ..... B41J 2/14233; B41J 2/04581; B41J 2002/14241; B41J 2002/14491; B41J 2002/14419
See application file for complete search history.

(56) References Cited

FOREIGN PATENT DOCUMENTS

JP 2010-208204 A 9/2010
JP 2010208204 A * 9/2010

OTHER PUBLICATIONS

IIP.com search (Year: 2022).*
"Preparation Methods and Application of Silicon Oxide Films", Wang et al., Abstract, 2014 (Year: 2014).*

* cited by examiner

*Primary Examiner* — Lisa Solomon
(74) *Attorney, Agent, or Firm* — Harness, Dickey & Pierce, P.L.C.

(57) ABSTRACT

A liquid ejecting head including a flow path forming substrate in which a pressure chamber in communication with a nozzle is formed, a diaphragm formed on the flow path forming substrate, and a piezoelectric actuator including a first electrode, a piezoelectric layer, and a second electrode that are formed on the diaphragm. In the liquid ejecting head, a center portion of the diaphragm is not provided with an active portion, which is a portion where the piezoelectric layer is interposed between the first electrode and the second electrode, a protective film that covers the diaphragm is formed in the center portion, and compressive stress of the protective film is larger than that of the diaphragm.

12 Claims, 7 Drawing Sheets

LIQUID EJECTING HEAD AND LIQUID EJECTING APPARATUS

The present application is based on, and claims priority from JP Application Serial Number 2019-157935, filed Aug. 30, 2019, the disclosure of which is hereby incorporated by reference herein in its entirety.

BACKGROUND

1. Technical Field

The present disclosure relates to a liquid ejecting head that ejects a liquid through nozzles and to a liquid ejecting apparatus and, in particular, relates to an ink jet recording head that ejects ink serving as the liquid and to an ink jet recording system.

2. Related Art

In a known ink jet recording head that ejects ink, a diaphragm is provided on a flow path forming substrate in which a pressure chamber is formed, and a piezoelectric actuator is provided on the diaphragm. The known piezoelectric actuator is formed by layering, from the diaphragm side, a first electrode, a piezoelectric layer, and a second electrode.

In one known form of the piezoelectric actuator, an active portion of the piezoelectric actuator is provided in an edge portion of an area (hereinafter, a moveable area) of the diaphragm that opposes a pressure chamber, and the active portion is not provided in a center portion of the moveable area (see JP-A-2010-208204, for example). In other words, in the piezoelectric actuator, the active portion having an annular shape is provided on the diaphragm so as to overlap the edge portion in plan view. The active portion is not provided in the center portion, and the diaphragm is exposed.

However, in the piezoelectric actuator configured in the above-described manner, the amount of displacement of the diaphragm cannot be said to be sufficient, making it difficult to eject large ink droplets. Furthermore, the resonance frequency of the diaphragm is limited, making it difficult to improve the frequency at which the droplets are ejected. Moreover, since the center portion of the diaphragm is provided with no piezoelectric layer and is exposed, cracking may occur in the diaphragm.

Note that such issues exist not only in ink jet recording heads but also, in a similar manner, in liquid ejecting heads that eject a liquid other than ink.

SUMMARY

In view of the above circumstances, an object of the present disclosure is to provide a liquid ejecting head and a liquid ejecting apparatus in which the amount of each droplet is increased, in which the frequency at which the droplets are ejected is improved, and in which reliability is improved.

An aspect of the present disclosure that overcomes the above issues is a liquid ejecting head including a flow path forming substrate in which a pressure chamber in communication with a nozzle is formed, a diaphragm formed on one side of the flow path forming substrate, and a piezoelectric actuator including a first electrode, a piezoelectric layer, and a second electrode that are formed on the diaphragm on a side opposite the flow path forming substrate. In the liquid ejecting head, a center portion of the diaphragm, the center portion being an area opposing the pressure chamber in plan view, is not provided with an active portion, which is a portion where the piezoelectric layer is interposed between the first electrode and the second electrode, a protective film that covers the diaphragm is formed in the center portion, and compressive stress of the protective film is larger than that of the diaphragm.

Furthermore, another aspect is a liquid ejecting head including a flow path forming substrate in which a pressure chamber in communication with a nozzle is formed, a diaphragm formed on one side of the flow path forming substrate, and a piezoelectric actuator including a first electrode, a piezoelectric layer, and a second electrode that are formed on the diaphragm on a side opposite the flow path forming substrate. In the liquid ejecting head, a center portion of the diaphragm, the center portion being an area opposing the pressure chamber in plan view, is not provided with an active portion, which is a portion where the piezoelectric layer is interposed between the first electrode and the second electrode, a protective film that covers the diaphragm is formed in the center portion, and tensile stress of the protective film is larger than that of the diaphragm.

Furthermore, another aspect is a liquid ejecting apparatus including the liquid ejecting head described above.

DESCRIPTION OF EXEMPLARY EMBODIMENTS

Figure 1:
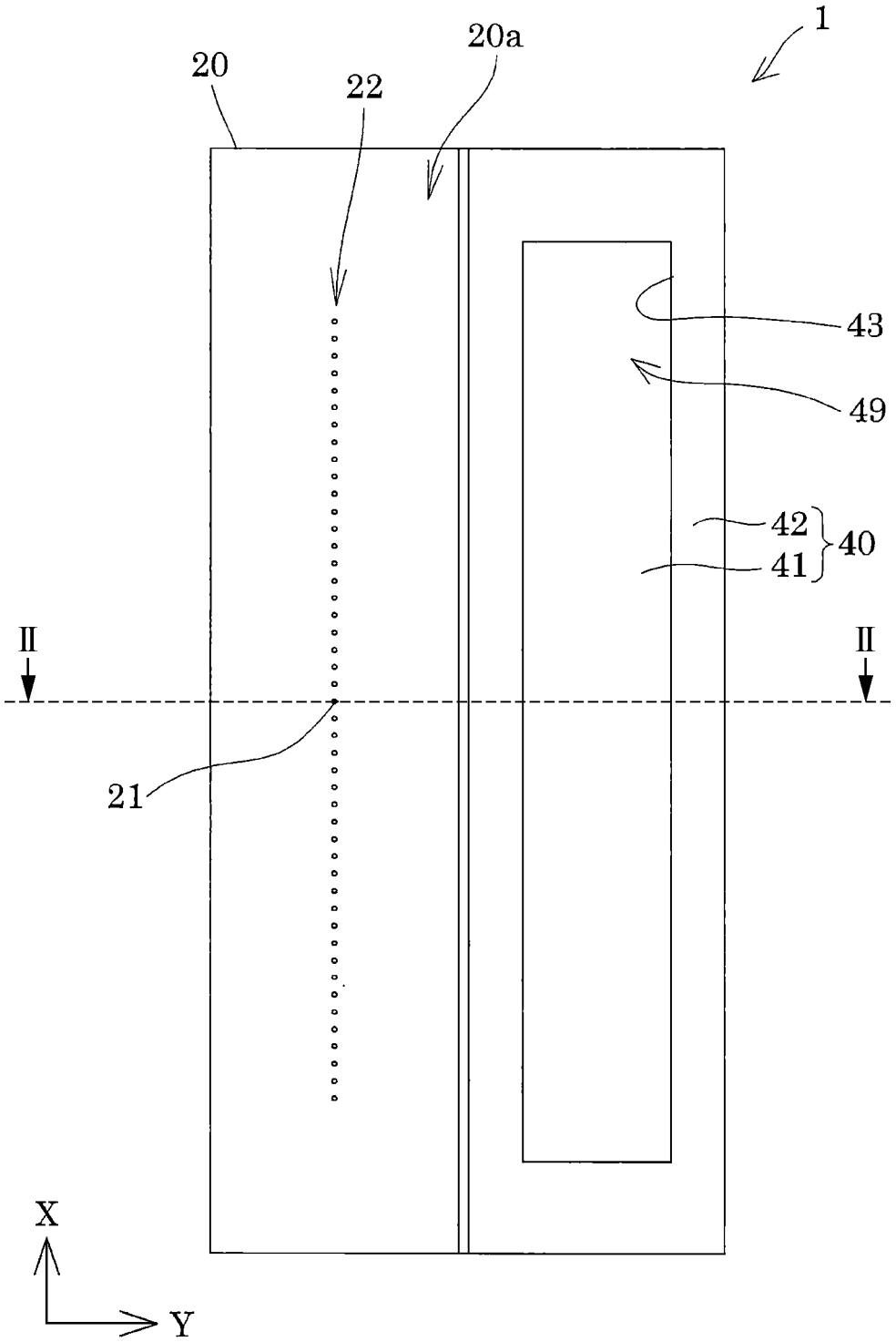
FIG. 1 is a plan view of a recording head according to a first exemplary embodiment.

The present disclosure will be described in detail with reference to the exemplary embodiments. However, the description hereinafter illustrates an aspect of the present disclosure and can be modified in any manner within the scope of the present disclosure. Members attached with the same reference numerals in the drawings depict the same member and description thereof is appropriately omitted. Furthermore, X, Y, and Z in the drawings indicate three spatial axes that are orthogonal to each other. In the present specification, directions extending along the above axes are referred to as an X direction, a Y direction, and a Z direction. The description will be given while a positive (+) direction is a direction in which each of the arrows in the drawings is oriented and a negative (−) direction is a direction opposite the direction in which each of the arrows is oriented. Furthermore, the Z direction indicates a vertical direction, a +Z direction indicates vertically downwards, and a −Z direction indicates vertically upwards.

First Exemplary Embodiment

Figure 2:
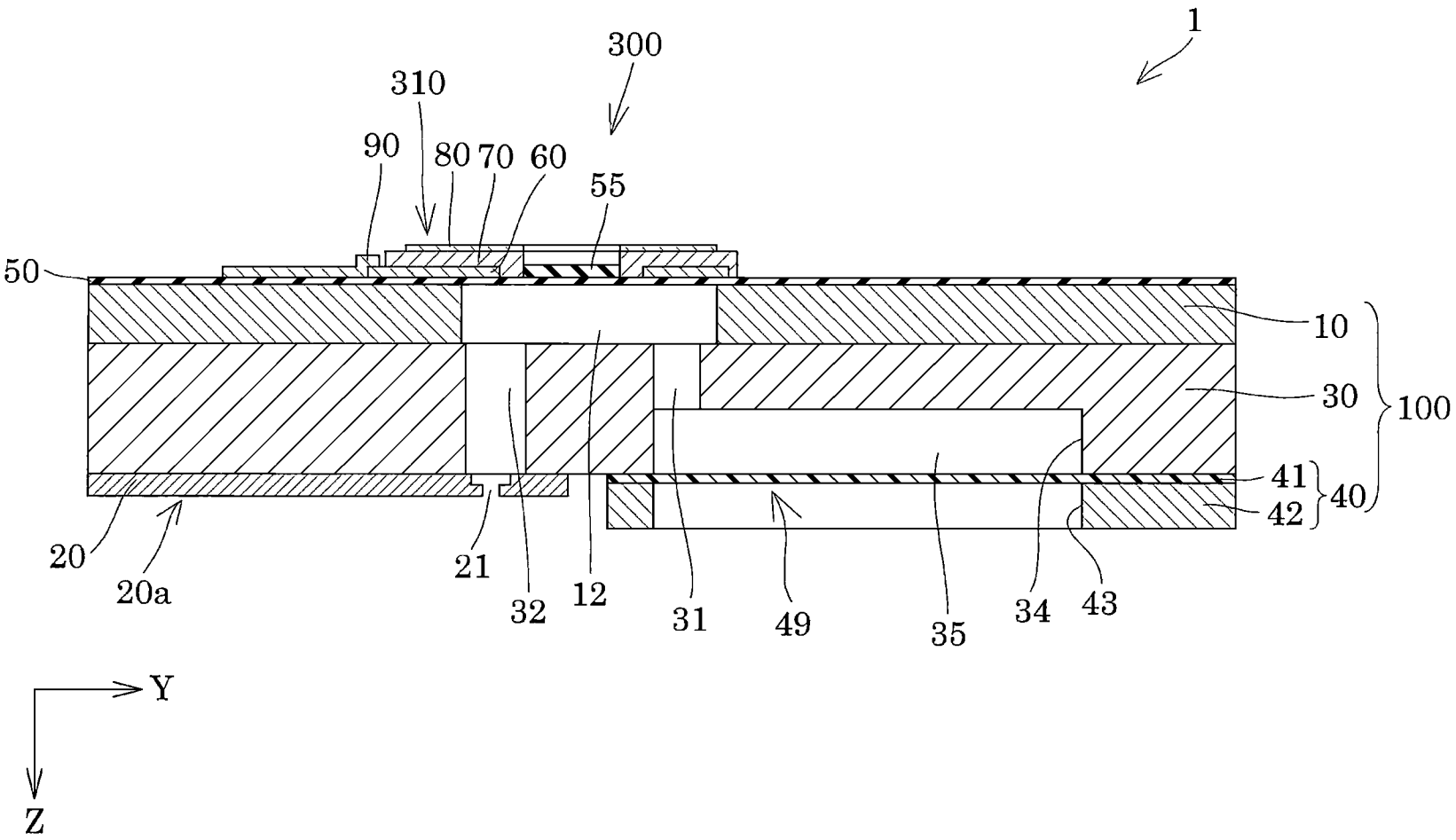
FIG. 2 is a cross-sectional view of the recording head according to the first exemplary embodiment.
Figure 3:
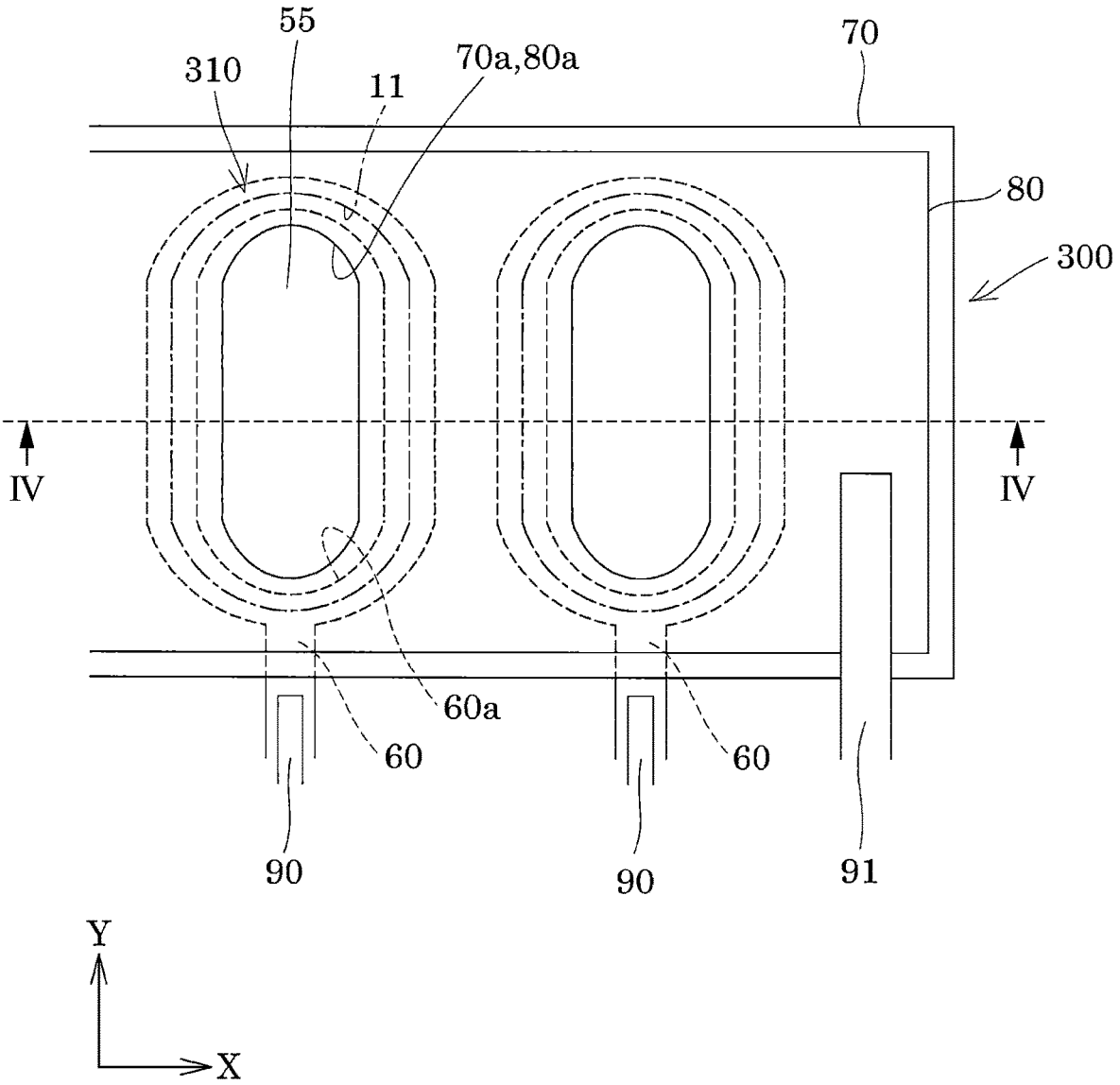
FIG. 3 is a plan view of an essential portion of piezoelectric actuators according to the first exemplary embodiment.
Figure 4:
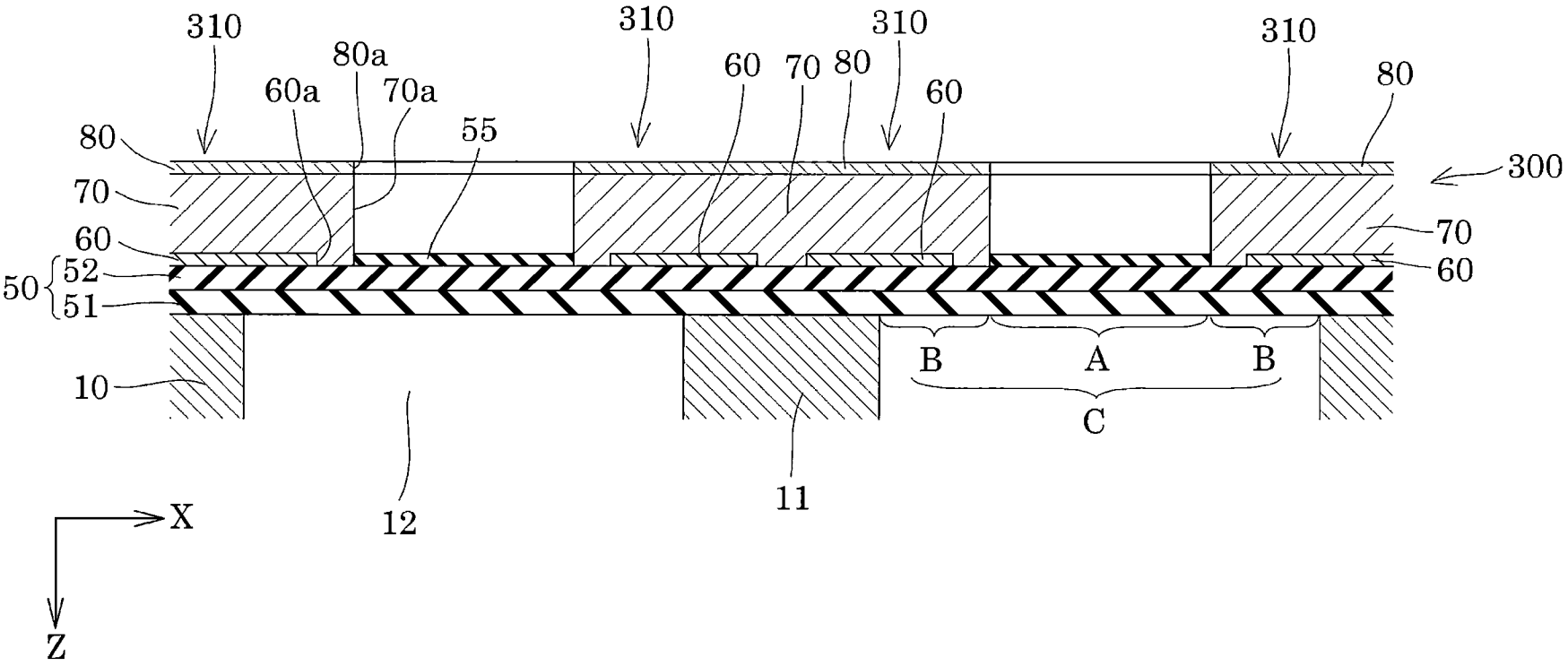
FIG. 4 is a cross-sectional view of an essential portion of the piezoelectric actuators according to the first exemplary embodiment.

Referring to FIGS. 1 to 4, a description of an ink jet recording head (hereinafter, referred to as a recording head), which is an example of a liquid ejecting head, will be given. FIG. 1 is a plan view of the recording head viewed from a nozzle surface side. FIG. 2 is a cross-sectional view taken along line II-II in FIG. 1. FIG. 3 is a plan view of essential portions of piezoelectric actuators provided in the recording head illustrated in an enlarged manner. FIG. 4 is a cross-sectional view taken along line IV-IV in FIG. 3.

The recording head 1 includes a flow path unit 100, a diaphragm 50, and piezoelectric actuators 300. The flow path unit 100 of the present exemplary embodiment is configured so that a flow path forming substrate 10, a common liquid chamber substrate 30, a nozzle plate 20, and a compliance substrate 40 are joined to each other.

The diaphragm 50 is formed on a −Z side of the flow path forming substrate 10. The diaphragm 50 of the present exemplary embodiment includes an elastic film 51 and an insulating film 52. The elastic film 51 is a film containing silicon oxide and is formed on one side of the flow path forming substrate 10 in the −Z direction. The insulating film 52 is a film containing zirconium oxide and is formed on the one side of the elastic film 51 in the −Z direction.

In the diaphragm 50 configured in the above manner, areas that oppose the pressure chambers 12 are referred to as moveable areas C. Furthermore, in each moveable area C in plan view, an area that is inside an end portion (a partition wall 11) of the corresponding pressure chamber 12 and that does not include the center of the pressure chamber 12 is referred to as an edge portion B. Furthermore, in the moveable area C, an area other than the edge portion B is referred to as a center portion A.

The flow path forming substrate 10 is a silicon single crystal substrate and is a substrate in which the pressure chambers 12 are formed. Specifically, a plurality of pressure chambers 12 partitioned by a plurality of partition walls 11 are formed in the flow path forming substrate 10.

The plurality of pressure chambers 12 are arranged side by side at a predetermined pitch in the X direction, which is a direction in which a plurality of nozzles 21 that discharge ink are arranged side by side. A single row of pressure chambers 12 arranged side by side in the X direction is provided in the present exemplary embodiment. Furthermore, the flow path forming substrate 10 is disposed so that an in-plane directions thereof includes the X direction and the Y direction. It goes without saying that the arrangement of the pressure chambers 12 is not limited to the above and, for example, may be a so-called staggered arrangement in which, in the pressure chambers 12 arranged side by side in the X direction, every other pressure chamber 12 is disposed at a position shifted in the Y direction. Furthermore, the arrangement of the pressure chambers 12 may be a so-called matrix arrangement in which a plurality of pressure chambers 12 are arranged at predetermined intervals in the X direction and the Y direction.

The shape of the pressure chamber 12 of the present exemplary embodiment in plan view (see FIG. 3) is a substantially elliptical shape, in which the Y direction is the major axis. As illustrated in FIG. 2, a first flow path 31 and a second flow path 32 are coupled to two ends of the pressure chamber 12 in the longitudinal direction thereof. Note that the shape of the pressure chamber 12 is not limited in particular to the above shape and, for example, may have a square shape, a rectangular shape, a polygonal shape, a parallelogram shape, a circular shape, or a long hole shape. Incidentally, a long hole shape is an oval shape or a shape that resembles an oval shape such as, for example, a rectangular shape with round corners, an egg shape, and an elliptical shape.

Such pressure chambers 12 are formed by performing anisotropic etching on the flow path forming substrate 10 from a side on which the nozzle plate 20 is joined, and surfaces of the pressure chambers 12 on a side opposite the nozzle plate 20 are defined by the diaphragm 50.

The common liquid chamber substrate 30 is a substrate in which a common liquid chamber 35 in communication with the pressure chambers 12 is formed, and is provided on the +Z side of the flow path forming substrate 10. The common liquid chamber substrate 30 can be fabricated of, for example, metal such as stainless steel, glass, or a ceramic material. Desirably, a material that has a coefficient of thermal expansion that is substantially the same as that of the flow path forming substrate 10 is used for the common liquid chamber substrate 30. In the present exemplary embodiment, the common liquid chamber substrate 30 is formed using a silicon single crystal substrate that is a material that is the same as that of the flow path forming substrate 10.

A recessed portion 34 open towards the +Z side is formed in the common liquid chamber substrate 30. On a surface of the common liquid chamber substrate 30 on the +Z side, the compliance substrate 40 including a compliance portion 49 seals the opening of the recessed portion 34 on the +Z side. In the common liquid chamber substrate 30, the common liquid chamber 35 is formed by the compliance substrate 40 sealing the recessed portion 34.

In the present exemplary embodiment, such a compliance substrate 40 includes a sealing film 41 formed of a thin flexible film, and a fixture substrate 42 formed of a hard material such as metal. Since the area in the fixture substrate 42 opposing the common liquid chamber 35 is an opening portion 43, which is completely removed in the thickness direction, a portion of the wall surfaces of the common liquid chamber 35 is the compliance portion 49, which is a flexible portion sealed with the flexible sealing film 41 alone. By providing the compliance portion 49 in a portion of the wall surfaces of the common liquid chamber 35 in the above manner, the pressure change in the ink inside the common liquid chamber 35 can be absorbed by deformation of the compliance portion 49.

Furthermore, a plurality of first flow paths 31 each in communication with a corresponding pressure chamber 12 are formed in the common liquid chamber substrate 30. The first flow paths 31 are flow paths that couple the pressure chambers 12 and the common liquid chamber 35 to each other and are provided so as to penetrate the common liquid chamber substrate 30 in the Z direction. The first flow path 31 is in communication with the common liquid chamber 35 at the end portion in the +Z direction, and is in communication with the pressure chamber 12 at the end portion in the −Z direction.

Furthermore, a plurality of second flow paths 32 each in communication with a corresponding pressure chamber 12 and a corresponding nozzle 21 are formed in the common liquid chamber substrate 30. The second flow paths 32 are flow paths that couple the pressure chambers 12 and the nozzles 21 to each other and are provided so as to penetrate the common liquid chamber substrate 30 in the Z direction. The second flow path 32 is in communication with the nozzle 21 at the end portion in the +Z direction, and is in communication with the pressure chamber 12 at the end portion in the −Z direction.

The nozzle plate 20 is provided on the +Z side of the common liquid chamber substrate 30. A plurality of nozzles 21 that eject ink in the +Z direction is formed in the nozzle plate 20. As illustrated in FIG. 1, in the present exemplary embodiment, a single nozzle row 22 is formed by disposing the plurality of nozzles 21 along a straight line extending in the X direction. The nozzle plate 20 can be, for example, formed of a flat plate material made of metal such as stainless steel (SUS), an organic matter such as a polyimide resin, a silicon, or the like. It goes without saying that the arrangement of the nozzles 21 is not limited to the above and, for example, may be a so-called staggered arrangement in which, in the nozzles 21 arranged side by side in the X direction, every other nozzle 12 is disposed at a position shifted in the Y direction. Furthermore, the arrangement of the nozzles 12 may be a so-called matrix arrangement in which a plurality of nozzles 12 are arranged at predetermined intervals in the X direction and the Y direction.

Ink flow paths from the common liquid chamber 35 reaching the nozzles 21 through the first flow paths 31, the pressure chambers 12, and the second flow paths 32 are formed in the flow path unit 100 configured in the above manner. Note that while not particularly illustrated in the drawings, the common liquid chamber 35 is configured so that ink is supplied from an external ink supply member. The ink supplied from the external ink supply member is supplied to the common liquid chamber 35. Subsequently, the ink is supplied from the common liquid chamber 35 to each pressure chamber 12 through the corresponding first flow path 31. The ink in the pressure chambers 12 is, owing to the piezoelectric actuators 300 described later, ejected through the nozzles 21 via the second flow paths 32.

The piezoelectric actuators 300 each constituted by the first electrode 60, the piezoelectric layer 70, and the second electrode 80 layered by film forming and with a lithography method are situated on a surface of the diaphragm 50, which is formed on the flow path forming substrate 10, opposite the flow path forming substrate 10.

Either one of the electrodes of the piezoelectric actuator 300 is configured to serve as a common electrode. The other electrode and the piezoelectric layer 70 are formed in the corresponding pressure chamber 12 by patterning. In the present exemplary embodiment, the first electrode 60 is configured to serve as an individual electrode of the piezoelectric actuator 300, and the second electrode 80 is configured to serve as the common electrode of the piezoelectric actuator 300.

In the piezoelectric actuator 300, a portion where the piezoelectric layer 70 is interposed between the first electrode 60 and the second electrode 80 is referred to as an active portion 310. The active portion 310 is provided for each pressure chamber 12.

The active portion 310 is provided in the edge portion B of the moveable area C (see FIG. 4) of the diaphragm 50. The active portion 310 is not provided in the center portion A. Furthermore, in the present exemplary embodiment, the active portion 310 is provided outside the edge portion B, that is, the active portion 310 is provided to the outside of the pressure chamber 12.

Such a shape of the active portion 310 in plan view has, as illustrated in FIG. 3, a shape substantially similar to that of the pressure chamber 12, and is substantially an elliptical shape in which the longitudinal direction is the Y direction.

Each first electrode 60 is formed in an annular shape in plan view. In other words, similar to the pressure chamber 12, the first electrode 60 has a substantially elliptical outer circumferential shape in which the Y direction is the major axis, and an opening portion 60*a* having a shape substantially analogous to the outer circumferential shape at the center portion. Furthermore, the first electrode 60 is formed so as to overlap the partition wall 11. In other words, the opening portion 60*a* of the first electrode 60 is positioned inside the partition wall 11, and the outer circumference of the first electrode 60 is positioned outside the partition wall 11 (on the side opposite the pressure chamber 12). Note that the first electrode 60 is configured of a conductive material such as, for example, gold, silver, copper, palladium, platinum, or titanium.

The piezoelectric layer 70 is commonly formed for each active portion 310 so as to cover each first electrode 60. Furthermore, first through holes 70*a* penetrating in the thickness direction are formed in the piezoelectric layer 70. In plan view (see FIG. 3), the first through hole 70*a* is positioned inside the opening portion 60*a* of the first electrode 60, and includes an opening that has a shape that is substantially analogous to the opening portion 60*a*.

Such a piezoelectric layer 70 can be constituted by a ferroelectric piezoelectric material, such as a ceramics-based material including, for example, lead zirconate titanate (PZT) or the like. The piezoelectric layer 70 described above can be obtained by applying a piezoelectric material to cover the first electrodes 60 and by forming the first through holes 70*a* by etching. It goes without saying that the piezoelectric layer 70 does not have to be commonly provided for each first electrode 60 and can be formed for each first electrode 60.

The second electrode 80 is formed, commonly for the active portions 310, on the piezoelectric layer 70. Furthermore, second through holes 80*a* penetrating in the thickness direction is formed in the second electrode 80. The second through hole 80*a* has a shape that is substantially the same as that of the first through hole 70*a* and is disposed so as to overlap the first through hole 70*a*. Note that the second electrode 80 is configured of a conductive material such as, for example, gold, silver, copper, palladium, platinum, or titanium.

In the Y direction, each first electrode 60 is drawn to the outside of the piezoelectric layer 70. A first lead electrode 90 is coupled to each first electrode 60. A second lead electrode 91 is coupled to the second electrode 80. In the Y direction, the second lead electrode 91 is drawn out in a direction that is the same as that of the first lead electrodes 90.

Each first lead electrode 90 is coupled to the first electrode 60 of the corresponding piezoelectric actuator 300. A voltage is selectively applied to the piezoelectric actuators 300 through the first lead electrodes 90. Furthermore, the second lead electrode 91 is coupled to the second electrode 80 common to each of the piezoelectric actuators 300. A bias voltage is applied to the second electrode 80 through the second lead electrode 91.

In such a recording head 1, when a voltage is applied to the first electrodes 60 of the piezoelectric actuators 300 and to the second electrode 80, the active portions 310 become flexed and deformed. The diaphragm 50 becomes deformed due to flexing and deformation of the active portions 310, which applies pressure to the ink inside the pressure chambers 12 and ejects the ink through the nozzles 21. Note that the active portion 310 is provided in the edge portion B of the diaphragm 50 and the active portion 310 is not provided in the center portion A. In such a piezoelectric actuator 300 configured in the above manner, compared with a configuration in which the active portion 310 is provided in the center portion A, the amount of displacement of the diaphragm 50 is improved and the amount of ejected ink is increased.

Note that in the example described above, while the diaphragm 50 and the first electrode 60 act as a diaphragm, it goes without saying that not limited to the above, for example, the diaphragm 50 may not be provided and the first electrode 60 alone may act as a diaphragm. Furthermore, the piezoelectric actuator 300 itself may substantially serve as the diaphragm as well.

A protective film 55 that covers the diaphragm 50 is formed at the center portion A of the diaphragm 50. The internal stress of the protective film 55 is compressive stress. In the present exemplary embodiment, the protective film 55 is, in plan view illustrated in FIG. 3, provided in the first through hole 70*a* and the second through hole 80*a*, and is formed in a substantially elliptical shape. Note that the protective film 55 does not have to cover the entire surface of the center portion A of the diaphragm 50 and may be shaped to cover a portion thereof.

A size of the compressive stress of the protective film 55 is larger than a size of the compressive stress of the diaphragm 50. The compressive stress of the protective film 55 acts on the diaphragm 50 as tensile force in a plane direction. Accordingly, the tensile force acting on the diaphragm 50 due to the compressive stress of the protective film 55 is larger than the compressive stress of the diaphragm 50. Accordingly, in the diaphragm 50 as a whole, the compressing force is larger than the tensile force.

Since tensile force acts on the diaphragm 50 in the above manner, a resonance frequency of the diaphragm 50 can be improved. By improving the resonance frequency of the diaphragm 50, a drive frequency can be improved, and the rate at which the ink is ejected can be increased. In particular, since the center portion A of the diaphragm 50 is thin, in other words, unlike the edge portion B, since the active portion 310 is not provided, the effect of improving the resonance frequency with the protective film 55 is prominent.

The reason why an improvement in the resonance frequency effects the improvement of the drive frequency is as follows. In a recording head that uses a piezoelectric actuator, typically, the ink is ejected using resonance of the diaphragm. Accordingly, in order to discharge the ink at a high frequency, the resonance frequency of the diaphragm needs to be high in proportion to the drive frequency. In other words, when the resonance frequency of the diaphragm becomes higher, the drive frequency can be increased, and the ink can be discharged at a high frequency. The drive frequency is a frequency that drives the piezoelectric actuator with a drive pulse.

Note that "compressive stress of the protective film is larger than that of the diaphragm" stated in the claim is, as described above, not only incudes a case in which the internal stress of the diaphragm 50 is compressive stress but also includes a case in which the internal stress of the diaphragm 50 is tensile stress and a case in which there is no application of internal stress. The tensile stress of the diaphragm 50 and the tensile force to the diaphragm 50 with the protective film 55 act as tensile force to the diaphragm 50 and an effect of improving the resonance frequency, which has been described above, can be obtained. An effect similar to above can be obtained even when there is no internal stress applied to the diaphragm 50.

A film containing zirconium oxide ($ZrO_2$) can be used as the protective film 55 with compressive stress. Such a protective film 55 can be formed with a reactive sputtering technique. Furthermore, by forming a zirconium oxide layer with a liquid phase method, the protective film 55 with compressive stress containing zirconium oxide can be formed.

Furthermore, a diamond-like carbon film (DLC film) can be used as the protective film 55 with compressive stress. The DLC film can be one that contains silicon. Alternatively, the DLC film does not have to contain silicon. The DLC film can be formed with a plasma CVD technique, for example. When a DLC film of about 1 μm is formed with the plasma CVD technique, generally, there will be compressive stress. When a PIG plasma CVD apparatus is used, the hydrogen content is reduced by, for example, increasing the output of the plasma gun. As the hardness of the DLC film is increased by reducing the hydrogen content, the compressive stress can be increased. Furthermore, when an RF plasma CVD apparatus is used, the compressive stress of the DLC film can be increased as the bias voltage on the substrate side is reduced.

The DLC film has good adhesion with silicon, silicon oxide, silicon carbide, and germanium. Accordingly, by forming the protective film 55 including the DLC film on the diaphragm formed of the above material, the protective film 55 with good adhesion with the diaphragm can be formed.

Furthermore, a film containing titanium nitride (TiNx) can be used as the protective film 55 with compressive stress. By forming the film with a sputtering technique, the protective film 55 with compressive stress containing titanium nitride is formed.

Furthermore, the internal stress of the protective film 55 may be tensile stress. In such a case, the size of the tensile stress of the protective film 55 is larger than that of the tensile stress of the diaphragm 50. The tensile stress of the protective film 55 acts on the diaphragm 50 as force compressing in the plane direction. Accordingly, the compressing force acting on the diaphragm 50 with the tensile stress of the protective film 55 is larger than the tensile stress of the diaphragm 50. Accordingly, in the diaphragm 50 as a whole, the compressing force is larger than the tensile force.

Since the compressing force acts on the diaphragm 50 in the above manner, the tension of the diaphragm 50 can be loosened and the displacement amplitude of the diaphragm 50 can be increased. The increase in the displacement amplitude of the diaphragm 50 allows larger ink droplets to be ejected. The thickness of the edge portion B of the diaphragm 50 is made larger than that of the center portion A by providing the active portion 310 in the edge portion B. Accordingly, even when the displacement amplitude of the diaphragm 50 is improved, cracking in the edge portion B can be suppressed from occurring.

Note that "tensile stress of the protective film is larger than that of the diaphragm" stated in the claim is, as described above, not only incudes a case in which the internal stress of the diaphragm 50 is tensile stress but also includes a case in which the internal stress of the diaphragm 50 is compressive stress and a case in which there is no application of internal stress. The compressive stress of the diaphragm 50 and the force generated by the protective film 55 compressing the diaphragm 50 act as force compressing the diaphragm 50 and, as described above, the effect of allowing larger ink droplets to be ejected is obtained. An effect similar to above can be obtained even when there is no internal stress applied to the diaphragm 50.

A film containing zirconium oxide can be used as the protective film 55 with tensile stress. Specifically, after forming a zirconium layer formed of zirconium (Zr) with a gas phase method, by thermally oxidizing the zirconium layer, the protective film 55 with tensile stress containing zirconium oxide is formed. By controlling the temperature when thermally oxidizing the zirconium layer, the stress of the zirconium oxide can be controlled. As the firing temperature becomes higher, the tensile stress becomes larger.

Furthermore, a film containing tantalum oxide (TaOx) can be used as the protective film 55 with tensile stress. While the film containing tantalum oxide can be manufactured with a known method, typically, a tensile stress film is formed. Furthermore, a film containing titanium nitride (TiNx) can be used as the protective film 55 with tensile stress. Such a protective film containing titanium nitride can be formed with a CVD technique.

Note that while the protective film 55 described as an example is of a single layer, not limited to the above, the protective film 55 may be formed of a plurality of layers. In such a case, the protective film 55 as a whole can be made to have compressive stress or tensile stress by appropriately setting the materials of each layer, the manufacturing method, or the manufacturing condition.

As described above, in the recording head 1 of the present exemplary embodiment, the diaphragm 50 is not provided with the active portion 310 in the center portion A of the moveable area C that opposes the pressure chamber 12 in plan view, and a protective film 55 that covers the diaphragm 50 is formed in the center portion A. The compressive stress of the protective film 55 is larger than that of the diaphragm 50.

According to such a recording head 1, tensile force is made to act on the diaphragm 50 with the protective film 55, and the resonance frequency of the diaphragm can be improved. By improving the resonance frequency of the diaphragm 50, the drive frequency can be improved and the rate at which the ink is ejected can be increased.

Furthermore, in the recording head 1, the protective film 55 may have tensile stress that is larger than that of the diaphragm 50. According to such a recording head 1, the compressing force acts on the diaphragm 50 with the protective film 55 and the tension of the diaphragm 50 is loosened and the displacement amplitude of the diaphragm 50 can be increased. The increase in the displacement amplitude of the diaphragm 50 allows larger ink droplets to be ejected. Furthermore, even when the displacement amplitude of the diaphragm 50 is improved, cracking in the edge portion B can be suppressed from occurring.

Furthermore, as illustrated in FIG. 4, the diaphragm 50 of the present exemplary embodiment is substantially flat when in a state in which no voltage is applied to the piezoelectric actuator 300 (hereinafter, referred to as a non-vibrating state); however, the shape of the diaphragm 50 is not limited to such a shape. For example, while not illustrated in the drawing, in the non-vibrating state, the diaphragm may be flexed in a protruded manner towards the pressure chamber 12. Such a diaphragm is especially useful when a voltage with a drive waveform described next is applied to the piezoelectric actuator 300.

A drive waveform that contracts the pressure chamber 12 after expanding the pressure chamber 12 to eject the ink is used. When a voltage with such a drive waveform is applied to the piezoelectric actuator 300, the recording head including a diaphragm that is flexed in a protruded manner towards the pressure chamber 12 can, compared with a recording head 1 including a flat diaphragm 50, increase the amount of ink supplied to the pressure chamber 12. In other words, the pumping power supplying the ink from the common liquid chamber 35 (see FIG. 2) to each pressure chamber 12 can be improved when ejecting the ink.

Furthermore, in the present exemplary embodiment, the active portion 310 in plan view is provided outside the pressure chamber 12, in other words, the active portion 310 is also provided at a position that overlaps the partition wall 11. As described above, the piezoelectric actuator 300 improves the displacement of the diaphragm 50 by not providing the active portion 310 in the center portion A of the diaphragm 50. Furthermore, instead of not providing the active portion 310 in the center portion A, by providing the active portion 310 to up to the partition wall 11, the force of the piezoelectric actuator 300 deforming the diaphragm 50 can be obtained. The deforming efficiency of the diaphragm 50 with the piezoelectric actuator 300 can be increased with the above configuration. Furthermore, the center portion A of the diaphragm 50 is reinforced with the protective film 55. The diaphragm 50 is reinforced with the protective film 55 and a concern that a crack will occur is reduced. In other words, both an increase in the deforming efficiency of the diaphragm 50 and suppression of cracking can be achieved.

Furthermore, while the diaphragm 50 of the present exemplary embodiment is configured of two layers, namely, the elastic film 51 and the insulating film 52, the diaphragm 50 is not limited to such a configuration. For example, the diaphragm 50 may be configured of a single layer or may be configured of three or more layers. In particular, since the rigidity of the diaphragm 50 configured of two layers or more is improved, cracking can be suppressed from occurring in the diaphragm 50.

Furthermore, desirably, the bending strength of the protective film 55 is larger than that of the elastic film 51 that is, in the diaphragm 50, closest to the pressure chamber 12. The bending strength is a value of a bending stress calculated based on the maximum load until a test piece in a bending test becomes raptured, and is also referred to as a transverse rupture strength. Generally, zirconium oxide is known to have an especially large bending strength, which is at least larger than those of silicon and silicon dioxide. For example, when, in the diaphragm 50, the elastic film 51 is formed with silicon dioxide, and the protective film 55 is formed with zirconium oxide, the bending strength of the protective film 55 is larger than that of the elastic film 51. Cracking in the diaphragm 50 can be made not to occur easily with the protective film 55 and the diaphragm 50 configured in the above manner. In other words, the crack resistance of the diaphragm 50 is improved. As described above, since the crack resistance is improved, cracking can be suppressed from occurring in the diaphragm 50 even when the protective film 55 makes tensile force or compressing force act on the diaphragm 50.

Desirably, the Young's modulus of the protective film 55 is larger than that of the elastic film 51 that is, in the diaphragm 50, closest to the pressure chamber 12. Generally, the Young's modulus of zirconium oxide is larger than that of silicon. For example, when, in the diaphragm 50, the elastic film 51 is formed with silicon dioxide, and the protective film 55 is formed with zirconium oxide, the Young's modulus of the protective film 55 is larger than that of the elastic film 51. According to the protective film 55 and the diaphragm 50 configured in the above manner, since the rigidity of the protective film 55 is higher than that of the diaphragm 50, the tensile force or the compressing force made to act on the diaphragm 50 with the protective film 55 can be increased.

While the protective film 55 can be formed by the various materials described above, desirably, the protective film 55 uses zirconium oxide. The zirconium oxide can be formed to have compressive stress or tensile stress according to the manufacturing method and the manufacturing condition, and the size thereof can be controlled as well. Accordingly, by having zirconium oxide be the protective film 55, stress control of the compressive stress or the tensile stress is facilitated.

Desirably, the crystal structure of the zirconium oxide of the insulating film 52 includes a tetragonal crystal or a cubic crystal. Furthermore, desirably, a stabilized (partially stabilized) zirconia in which rare earth oxide such as yttrium oxide, calcium oxide, magnesium oxide, or hafnium oxide is added to zirconium oxide, or more desirably, yttria stabilized zirconia (YSZ) is used. In other words, desirably, the protective film 55 containing zirconium oxide contains yttrium. As described above, by using stabilized (partially stabilized) zirconia, the tetragonal or cubic crystal is stabilized even under a normal temperature and the toughness of the diaphragm 50 can be increased further. Since the toughness of the diaphragm 50 is high, rapture of the diaphragm 50 can be suppressed.

Furthermore, the zirconium oxide of the insulating film 52, desirably, includes granular crystals. Zirconium oxide including granular crystals can be formed by either of the known liquid phase method and the gas phase method. The diaphragm 50 containing zirconium oxide including granular crystals becomes a crystal structure in which particles of small diameters are aggregated in a sparse manner, and can be made into a flexible film with a small Young's modulus. Accordingly, the amount of displacement of the insulating film 52, in other words, the amount of displacement of the diaphragm 50 can be increased.

Second Exemplary Embodiment

Figure 5:
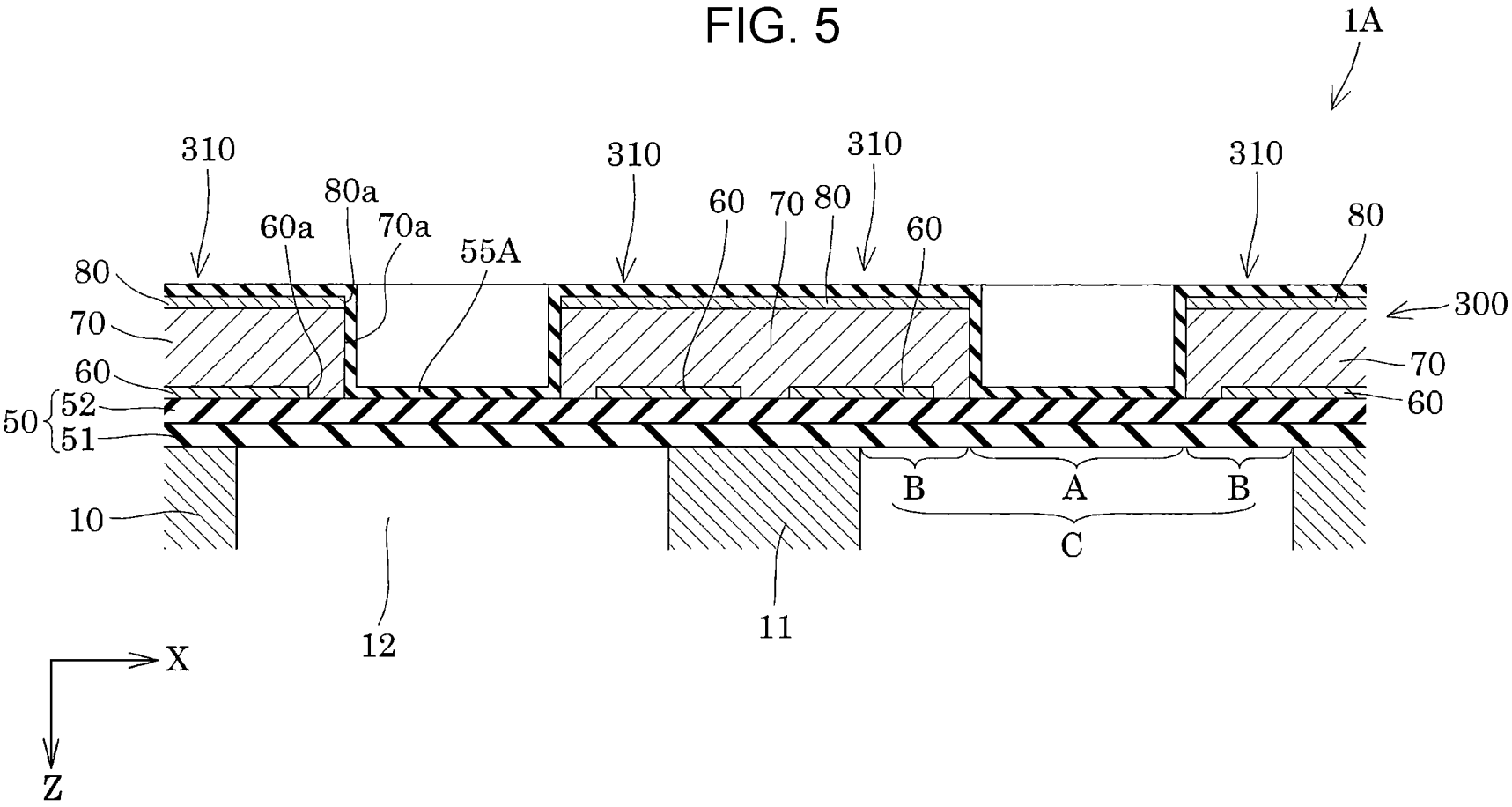
FIG. 5 is a cross-sectional view of an essential portion of piezoelectric actuators according to a second exemplary embodiment.

Referring to FIG. 5, a recording head according to a second exemplary embodiment will be described. Note that components that are the same as those of the first exemplary embodiment are denoted with the same reference numerals and repeated descriptions thereof are omitted.

In a recording head 1A of the present exemplary embodiment, a protective film 55A is provided on the center portions A of the diaphragm 50, the piezoelectric layer 70, and the surfaces of the second electrodes 80. In other words, the protective film 55A is continuously provided from the center portions A to the piezoelectric layer 70 and the second electrodes 80.

The protective film 55A can be formed on the center portions A of the diaphragm 50, the piezoelectric layer 70, and the surfaces of the second electrode 80 all at once. With the protective film 55A formed all at once in the above manner, variations in the amount of displacement caused in the center portions A of the diaphragm 50 and the edge portions B by the protective film 55A can be suppressed.

Note that while the protective film 55A of the recording head 1A of the present exemplary embodiment is provided on the surfaces of the piezoelectric layer 70 and the second electrodes 80, depending on the configuration of the piezoelectric layer 70 and the second electrodes 80, the protective film 55A may be provided on only either one of the above.

Third Exemplary Embodiment

Figure 6:
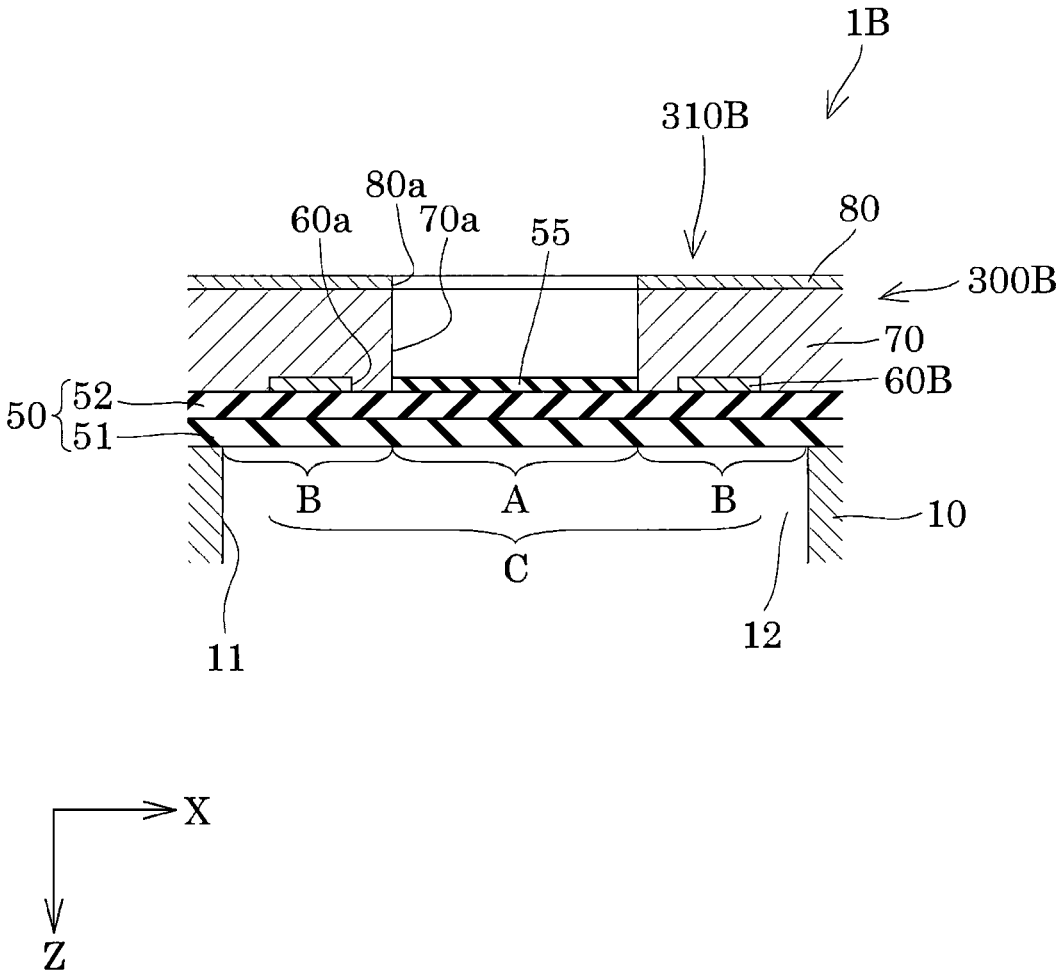
FIG. 6 is a cross-sectional view of an essential portion of piezoelectric actuators according to a third exemplary embodiment.

Referring to FIG. 6, a recording head according to a third exemplary embodiment will be described. Note that components that are the same as those of the first exemplary embodiment are denoted with the same reference numerals and repeated descriptions thereof are omitted.

In a recording head 1B of the present exemplary embodiment, different from the active portions 310 of the recording head 1 of the first exemplary embodiment, active portions 310B are not formed to the outside of pressure chambers 12. In other words, each active portion 310B is, in plan view, provided at a position that overlaps the corresponding pressure chamber 12.

Specifically, in a piezoelectric actuator 300B, an opening portion 60*a* of a first electrode 60B is positioned inside the partition wall 11, and an outer circumference of the first electrode 60B is also positioned inside the partition wall 11. By forming such a first electrode 60B, the active portion 310B is, in plan view, formed at a position that overlaps the pressure chamber 12.

Even in the recording head 1B configured in the above manner, an effect that is described in the first exemplary embodiment is obtained with the protective film 55 formed in the center portion A of the diaphragm 50. In other words, an effect of improving the resonance frequency of the diaphragm 50 can be obtained with any protective film 55 with compressive stress. Any protective film 55 with tensile stress can increase the amplitude of the diaphragm 50 and eject larger ink droplets, and can suppress cracking from occurring in the edge portion B of the diaphragm 50.

Other Exemplary Embodiment

While exemplary embodiments of the present disclosure has been described above, the basic configurations of the present disclosure are not limited to those described above.

In the exemplary embodiments, in a configuration in which the active portion 310 is not provided in the center portion A of the diaphragm 50, a configuration in which the protective film 55 alone is formed has been described as an example; however, the present disclosure is not limited such a configuration.

For example, the first electrode 60 may be formed in the center portion A of the diaphragm 50, and the protective film 55 may be formed on the first electrode 60. Since the first electrode 60 is formed and the piezoelectric layer 70 and the second electrode 80 are not formed in the center portion A, the active portion 310 is not formed in the center portion A. In such a configuration, the first electrode 60 substantially functions as a film that constitutes the diaphragm 50, and the advantageous effect of the protective film 55 can be obtained.

Other than the above, the protective film 55 may be provided in the center portion A of the diaphragm 50, and the piezoelectric layer 70 and the second electrode 80 may further be provided thereon. Since the first electrode 60 is not formed in the center portion A, the active portion 310 is not formed therein. In such a configuration as well, since the compressive stress or the tensile stress is made to act on the diaphragm 50 with the protective film 55, the advantageous effect of the protective film 55 can be obtained.

Figure 7:
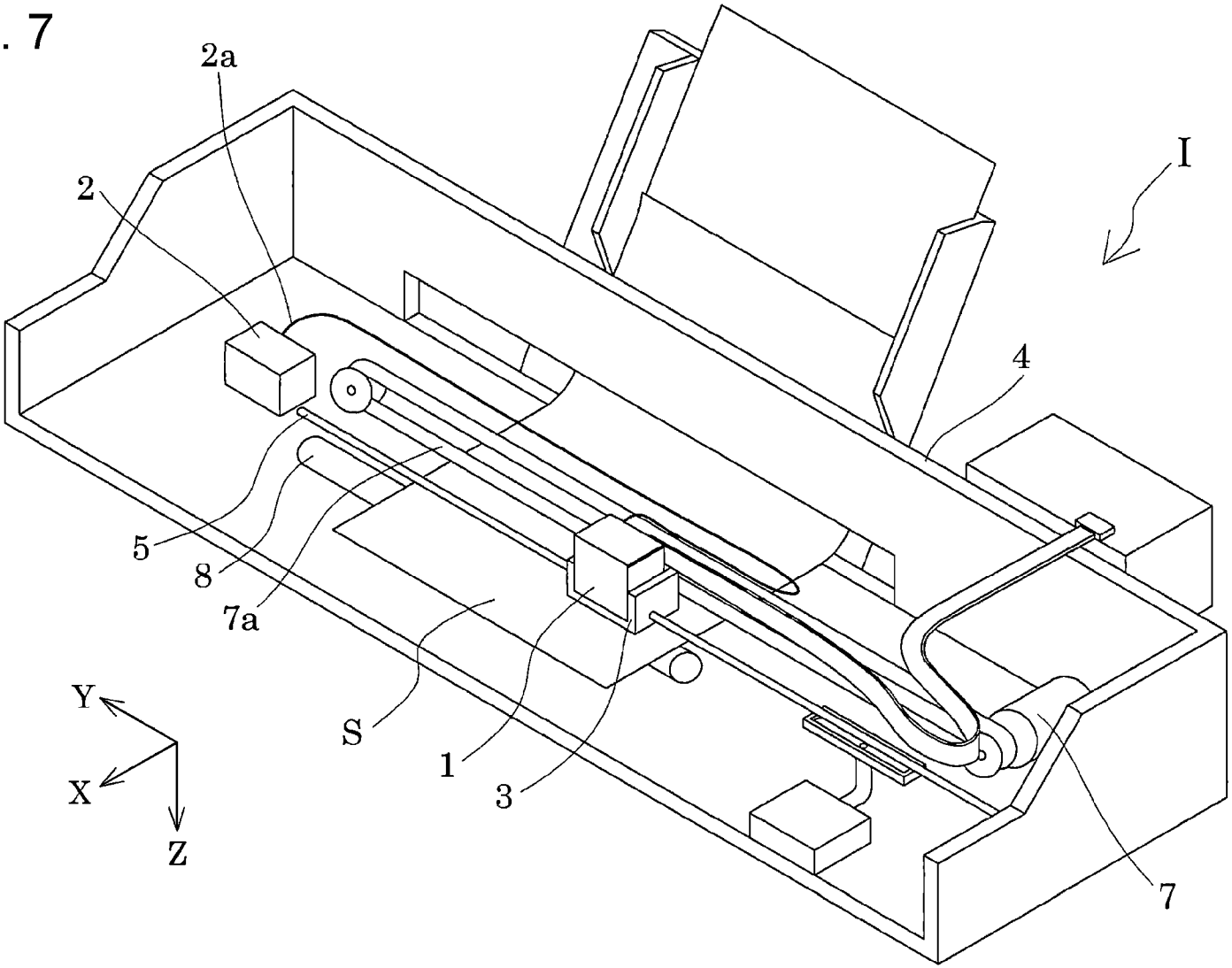
FIG. 7 is a diagram illustrating a schematic configuration of a recording apparatus according to an exemplary embodiment.

Referring now to FIG. 7, an example of an ink jet recording apparatus that is an example of a liquid ejecting apparatus of the present exemplary embodiment will be described. Note that FIG. 7 is a diagram illustrating a schematic configuration of the ink jet recording apparatus of the present disclosure.

In an ink jet recording apparatus I that is an example of the liquid ejecting apparatus, a plurality of recording heads 1 is mounted on a carriage 3. The carriage 3 on which the recording heads 1 are mounted is provided on a carriage shaft 5 attached to an apparatus body 4 so as to be moveable in an axial direction. In the present exemplary embodiment, the direction in which the carriage 3 moves is a first axial direction, which is the Y direction.

Furthermore, a tank 2 that is a storage member in which ink, serving as a liquid, is stored is provided in the apparatus body 4. The tank 2 is coupled to the recording heads 1 through supply pipes 2*a*, such as tubes and the like. The ink from the tank 2 is supplied to the recording heads 1 thorough the supply pipes 2*a*. Note that the apparatus may be configured with a plurality of tanks 2.

Furthermore, the carriage 3 on which the recording heads 1 are mounted is moved along the carriage shaft 5 by having driving force of a drive motor 7 be transmitted to the carriage 3 through a plurality of gears and a timing belt 7*a*. A transport roller 8 serving as a transport member is provided in the apparatus body 4. A recording sheet S, which is a medium such as paper on which ejection is performed, is transported with the transport roller 8. Note that the transport member that transports the recording sheet S is not limited to the transport roller 8 and may be a belt, a drum, or the like. In the present exemplary embodiment, the transport direction of the recording sheet S is the X direction.

Note that in the ink jet recording apparatus I described above, an example has been described in which the recording heads 1 mounted in the carriage 3 move in the main scanning direction; however, not limited to the above configuration in particular, for example, a so-called line recording apparatus in which the recording heads 1 are fixed and in which printing is performed by just moving the recording sheet S such as paper and the like in the sub scanning direction may be applied to the present disclosure.

Furthermore, in the exemplary embodiments, the ink jet recording head has been described as an example of the liquid ejecting head, and the ink jet recording apparatus has been described as an example of the liquid ejecting apparatus; however, the present disclosure is subject widely to liquid ejecting heads and liquid ejecting apparatuses in general. It goes without saying that the present disclosure can be applied to liquid ejecting heads and liquid ejecting apparatuses that eject a liquid other than ink. Other liquid ejecting heads include, for example, various recording heads used in image recording apparatuses such as a printer, a coloring material ejecting head used in manufacturing a color filter of a liquid crystal display and the like, an electrode material ejecting head used to form electrodes of an organic EL display, a field emission display (FED), and the like, and a bio organic matter ejecting head used to manufacture biochips. The present disclosure can also be applied to liquid ejecting apparatuses that include the above liquid ejecting heads.

What is claimed is:

1. A liquid ejecting head comprising:

a flow path forming substrate in which a pressure chamber in communication with a nozzle is formed;

a diaphragm formed on one side of the flow path forming substrate; and a piezoelectric actuator including a first electrode, a piezoelectric layer, and a second electrode that are formed on the diaphragm on a side opposite the flow path forming substrate, wherein a center portion of the diaphragm, the center portion being an area opposing the pressure chamber in plan view, is not provided with an active portion, which is a portion where the piezoelectric layer is interposed between the first electrode and the second electrode, a protective film that covers the diaphragm is formed in the center portion, and compressive stress of the protective film is larger than that of the diaphragm.

2. The liquid ejecting head according to claim 1, wherein the diaphragm is flexed so as to protrude towards the pressure chamber.

3. The liquid ejecting head according to claim 1, wherein the protective layer covers the piezoelectric layer or the second electrode.

4. The liquid ejecting head according to claim 1, wherein the active portion is provided to an outside of the pressure chamber in plan view.

5. The liquid ejecting head according to claim 1, wherein the diaphragm is configured of two or more layers of film.

6. The liquid ejecting head according to claim 1, wherein bending strength of the protective film is larger than that of a layer that is, in the diaphragm, closest to the pressure chamber.

7. The liquid ejecting head according to claim 1, wherein Young's modulus of the protective film is larger than that of a layer that is, in the diaphragm, closest to the pressure chamber.

8. The liquid ejecting head according to claim 1, wherein the protective film contains zirconium oxide.

9. The liquid ejecting head according to claim 1, wherein the diaphragm contains zirconium oxide, and a crystal structure of the zirconium oxide of the diaphragm includes a tetragonal crystal or a cubic crystal.

10. The liquid ejecting head according to claim 1, wherein the diaphragm contains yttrium.

11. The liquid ejecting head according to claim 9, wherein the zirconium oxide of the diaphragm includes a granular crystal.

12. A liquid ejecting apparatus comprising:

the liquid ejecting head according to claim 1.

* * * * *